United States Patent [19]

Oda

[11] Patent Number: 4,834,564

[45] Date of Patent: May 30, 1989

[54] PAPER FEED CONTROL IN A DOT MATRIX PRINTER

[75] Inventor: Akira Oda, Shizuoka, Japan

[73] Assignee: Tokyo Electric Co., Ltd., Tokyo, Japan

[21] Appl. No.: 71,579

[22] Filed: Jul. 10, 1987

Related U.S. Application Data

[63] Continuation of Ser. No. 754,396, Jul. 11, 1985, abandoned.

[30] Foreign Application Priority Data

Jul. 30, 1984 [JP] Japan ..... 59-157176

[51] Int. Cl.[4] ..... B41J 3/10

[52] U.S. Cl. ..... 400/121; 400/568; 400/902

[58] Field of Search ..... 400/120, 121, 124, 568, 400/902, 903, 577; 226/122; 318/685, 696

[56] References Cited

U.S. PATENT DOCUMENTS 3,643,039 2/1972 Barcomb et al. ..... 400/902
4,203,678 5/1980 Nordstrom et al. ..... 400/903
4,224,628 9/1980 Murray ..... 400/120

FOREIGN PATENT DOCUMENTS 6032 2/1981 Japan ..... 400/121
165279 10/1982 Japan ..... 400/902

*Primary Examiner*—David A. Wiecking
*Attorney, Agent, or Firm*—Frishauf, Holtz, Goodman & Woodward

[57] ABSTRACT

A paper feed control apparatus for a dot printer is provided which supplies a step pulse to a stepping motor in a one-pitch feed mode at an interval of a reference time to intermittently rotate the stepping motor in increments of a step angle, and which also supplies a step pulse to the stepping motor in a multi-pitch feed mode at an interval of a time shorter than the reference time to continuously rotate the stepping motor over a plurality of step angles. A motor drive control circuit is adapted to supply a step pulse to the stepping motor in the multi-pitch feed mode at a gradually shorted time interval, and to supply a final step pulse to the stepping motor in a final portion of a driving cycle when the reference time passes after the generation of the step pulse.

8 Claims, 5 Drawing Sheets

PAPER FEED CONTROL IN A DOT MATRIX PRINTER

This application is a continuation of application Ser. No. 754,396, filed July 11, 1985, now abandoned.

BACKGROUND OF THE INVENTION

This invention relates to a paper feed control apparatus and method for a dot printer through which a paper feed operation is selectively set in either a one-pitch feed mode or a multi-pitch feed mode to feed, over one pitch or a preset number of pitches, a sheet of printing paper in a direction perpendicular to a printing direction.

In general, the dot printer is adapted such that, while moving a printing head-mounted carriage at an even speed along a platen with a sheet of printing paper set thereon, it can read, from a character generator, a dot pattern corresponding to a character code input externally, and then print the character in question on the sheet of printing paper. As shown in FIG. 1, for example, the dot printer has eight printing needles 2 in a longitudinal array. Accordingly, therefore, the longitudinal array of a dot pattern character printed by the printing head 1 is comprised of eight dots.

A simple character, such as a numeral, for example, even though comprised of only eight dots in a longitudinal array, can be sufficiently legible. However, a complex character such as a Chinese character, is, if so comprised, not sufficiently reproduced to express the features of the character. Therefore, after printing has been completed once by the printing head with eight needles, the character corresponding to the same input character code is re-printed on substantially the same area of the sheet of printing paper, with the sheet fed at one pitch equal to one half the dot-to-dot distance. In this way, if substantially the same character is printed on the two areas with the sheet fed or displaced at one pitch, the complex character, such as the Chinese character, can be exactly expressed as if the dots in the longitudinal array were comprised of substantially 16 dots and, furthermore, the simple character, such as the numeral, can be represented beautifully and precisely. When a line feed is to be effected after the per line printing of the characters has been completed, the sheet of printing paper is fed, over the number of pitches, at a time corresponding to a distance of a sum of one character height and the height of a line-to-line spacing. For example, with the line-to-line spacing set to eight pitches corresponding to one half of the character height, the sheet is fed over 24 pitches at a time as a paper feed. Here, "a one-pitch feed mode" refers to a mode in which the sheet of printing paper is fed at one pitch at a time, and "a multi-pitch feed mode" refers to a mode in which the sheet of printing paper is fed over a predetermined number of pitches at a time.

In order to feed the sheet of printing paper, a stepping motor, used as a paper feed motor, is coupled to a platen through a power transmission mechanism, such as a gear, and rotated in response to a step pulse for the purpose of driving the platen. The gear ratio of the coupling gear is so adjusted that, when the stepping motor is rotated by one step upon receipt of a one step pulse, the sheet of printing paper is fed over a distance corresponding to one pitch. Thus, when the stepping motor receives a one step pulse, the sheet is fed by one step at a time, while, when the stepping motor receives 24 step pulses, the sheet is fed over a distance corresponding to the 24 step pulses: 24 steps at a time for line feed.

Since the one-pitch and multi-pitch feed mode are selected as required, the paper feed control device for a dot printer poses the following problem. That is, in order to increase the entire printing speed, the rotation speed of the stepping motor is increased in the multi-pitch feed mode during the paper feed operation to shorten the time required for paper feed. As appreciated from the above, the multi-pitch feed mode is different from the one-pitch feed mode with respect to the speed at which the sheet is fed, i.e., at one pitch at a time. In other words, they are different from each other with respect to the rotation speed of the stepping motor. As a result, there is a risk that the distance over which the sheet is fed in the respective feed mode will differ from pitch to pitch. More specifically, where the stepping motor is rotated at a high speed, a greater load is applied to the motor and power transmission mechanism, with the result that there is a tendency for the pitch to be somewhat lengthened. A relative gradual displacement occurs between when the sheet is fed, at first, in the one-pitch feed mode, in the multi-feed mode over a distance corresponding to 16 pitches as indicated by broken lines in FIG. 2A and then in the one-pitch feed mode, and when the sheet is sequentially fed in the one-pitch feed mode as indicated by solid lines in FIG. 2B. Thus, an error or discrepancy DO between a diagonal dot array of eight dots (as indicated by open circles) printed after the paper feed has been effected in the multi-pitch feed mode, as shown in FIG. 3, and a diagonal dot array of eight dots (as indicated by solid circles) printed after the paper feed is performed, one pitch at a time, in the one-pitch feed mode. This may result in both an illegible dot pattern character and in a lowered printing quality.

SUMMARY OF THE INVENTION

It is, accordingly, the object of this invention to provide a paper feed control method and apparatus for a dot printer through which it is possible to set the distance at which a sheet of printing paper is fed in a one-pitch feed mode at one pitch so as to be equal to an average distance of the respective pitches over which the sheet is fed in a multi-pitch feed mode.

This object can be attained by a paper feed control apparatus for a dot printer, comprising a stepping motor adapted to be rotated in increments of one step in response to a step pulse, a counter to which data representing the number of pitches is set to feed the paper and a motor drive control circuit for supplying the step pulse to the stepping motor at a time interval corresponding to the contents of the counter; changing the contents of the counter each time the step pulse is generated, supplying the step pulse to the stepping motor in a one-pitch feed mode at an interval of a reference time TO when the stepping motor is intermittently rotated in increments of one step angle and supplying, when the stepping motor is continuously rotated over a plurality of step angles, a final step pulse to the motor, in a multi-pitch feed mode, after the lapse of the reference time TO from the generation of the previous step pulse.

According to this invention, under substantially the same conditions as in the one-pitch feed mode, the sheet of printing paper is fed, in the multi-pitch feed mode, within a time from the generation of a preceding step pulse to the generation of the next final step pulse, set as the reference time TO. In consequence, even if, in the multi-pitch feed mode, the stepping motor is continuously rotated over a predetermined number of step angles, or, even if, in the one-pitch feed mode, the stepping motor is intermittently rotated over a predetermined number of the step angles, their total amounts of paper feed are substantially equal to each other.

The object of the above-mentioned invention is also attained by a paper feed control method for use in a dot printer, comprising the steps of supplying a step pulse to a stepping motor in a one-pitch feed mode at an interval of a reference time TO to intermittently rotate the stepping motor at a reference speed VO, supplying a step pulse to the stepping motor in a multi-pitch feed mode during at least a portion of a driving period at a time inverval shorter than the reference time TO and at a speed faster than the reference speed VO, and of supplying a final step pulse to the stepping motor to rotate the stepping motor at the reference speed VO.

According to this invention, since the stepping motor is rotated at the reference speed VO immediately before stoppage of the stepping motor, it is possible to stop the stepping motor under substantially the same conditions as in the one-pitch feed mode. Where, therefore, an equal number of step pulses are supplied to the stepping motor, the same total amount of movement can be obtained during the paper feed time irrespective of either the multi-pitch feed mode or the one-pitch feed mode.

DETAILED DESCRIPTION OF THE PREFERRED EMBODIMENT

One embodiment of this invention will be explained below with reference to the accompanying drawings.

Figure 4:
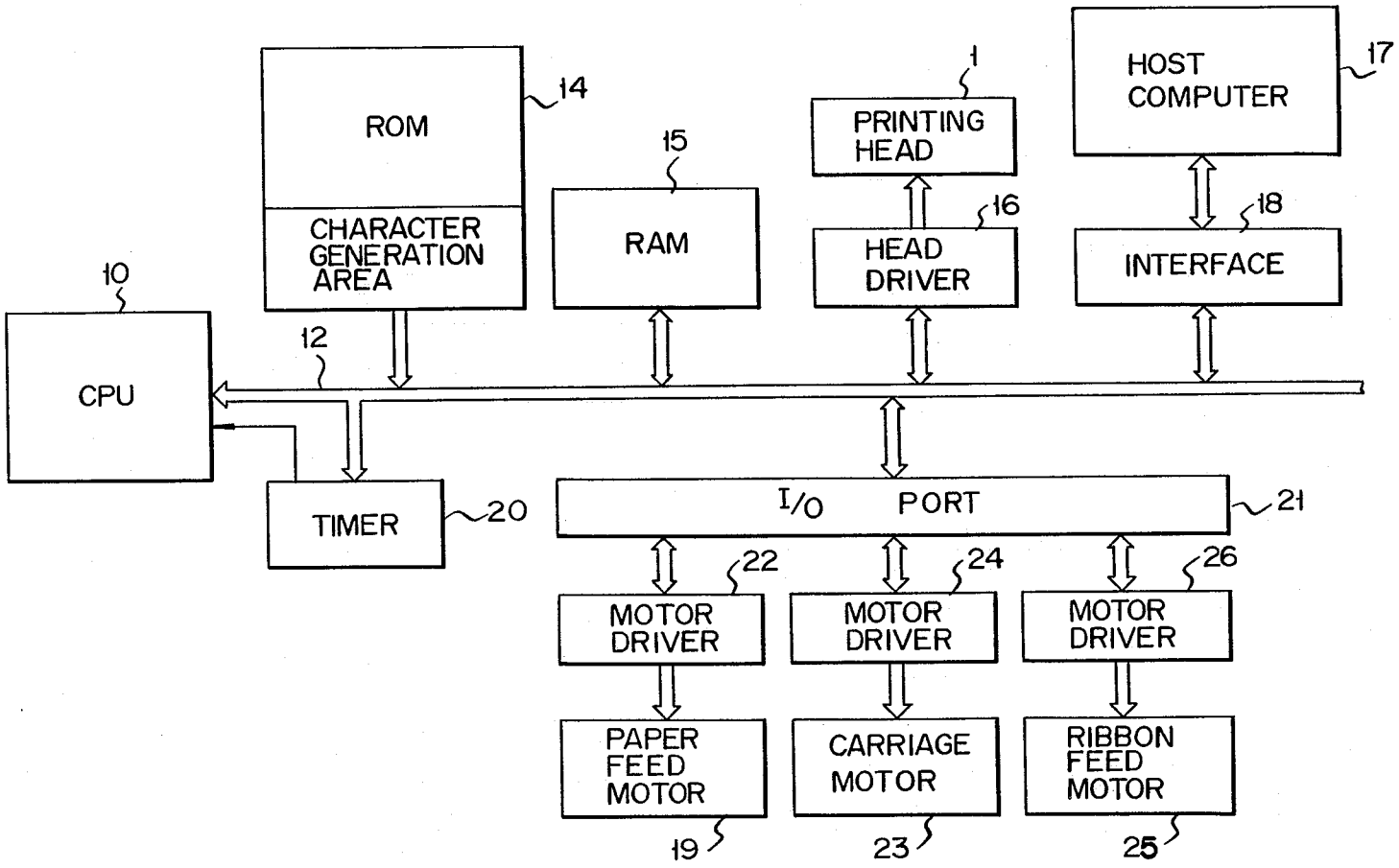
FIG. 4 is a block diagram showing a dot printer equipped with a paper feed control apparatus according to one embodiment of this invention.

FIG. 4 shows a block diagram showing a dot printer equipped with a paper feed control apparatus according to the embodiment of this invention. The printer comprises a central processing unit (CPU) 10 for performing various computation processes based on, for example, an external input character code, a read only memory (ROM) 14 connected through a data bus 12 to the CPU to store fixed data such as a control program and character data, and a random access memory (RAM) 15 for temporarily storing various variable data. To CPU 10 are connected, over the data bus 12, a print head driver 16 for sending a drive signal to a printing head 1 with a longitudinal array of eight needles as shown in FIG. 1, with a host computer 17 for sending various instructions, such as character codes, through an interface 18, a timer 20 for controlling the rotation speed of a stepping motor (paper feed motor) 19 connected through, for example, a gear to a platen (not shown), and an I/O port 21 for sending data to drive circuits of the stepping motor 19 and the other motors.

Figure 1:
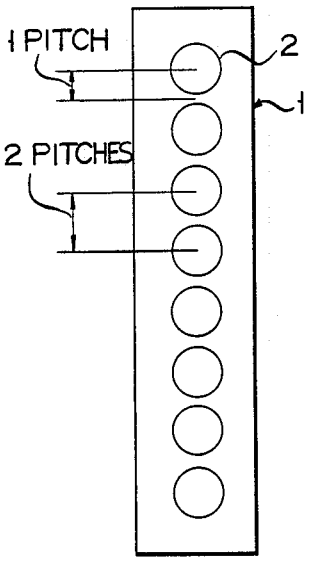
FIG. 1 (PRIOR ART)
FIG. 1 shows a conventional printing head having eight head pins.

To the I/O port 21 are connected a motor 22 driver for sending a step pulse to the paper feed motor 19 to rotate the stepping motor, a motor driver 24 for sending a drive signal to a carriage motor 23 for driving the carriage (not shown), on which the printing head, as shown in FIG. 1, is mounted, and a motor driver 26 for driving a printing ribbon motor 25 for sending the printing ribbon.

The stepping motor 19 has a plurality of excitation phases and is driven upon receipt of the step pulse. The gear ratio, for example, of the gears of the coupler which is connected between the stepping motor 19 and the platen is so adjusted that a one step rotation angle, when one step pulse is input to the motor 19 corresponds to one pitch, shown in FIG. 1. Therefore, the terms "one-pitch" and "one step rotation angle" are used interchangeably.

Figure 5A:
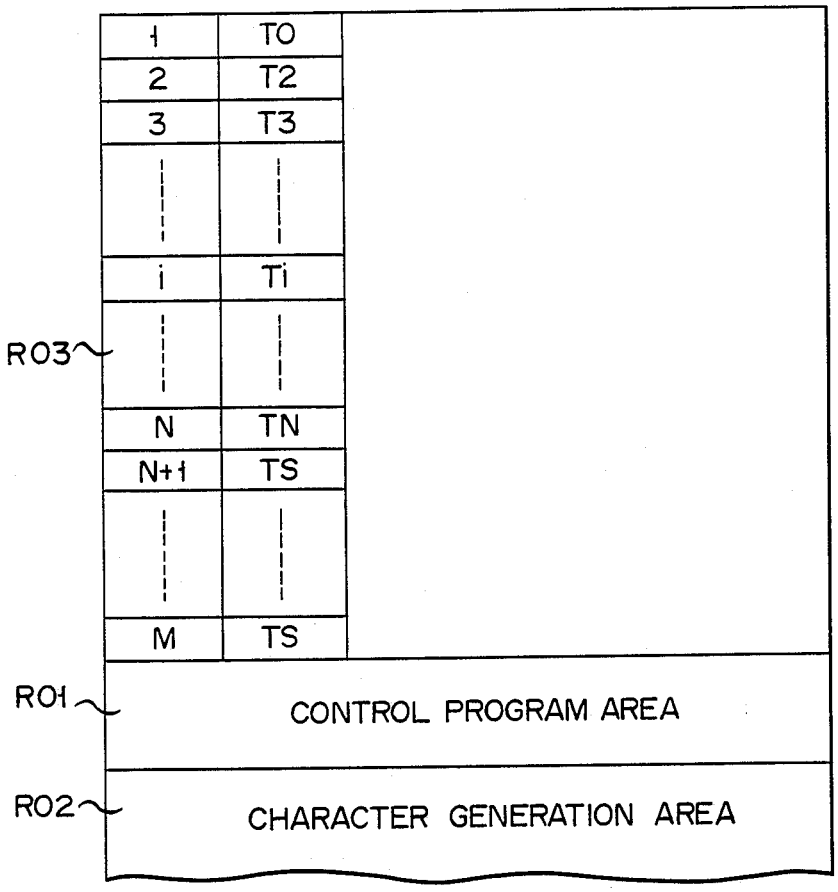
FIGS. 5A and 5B show maps of a read only memory and a random access memory used in the paper feed control apparatus as shown in FIG. 4.

As shown in FIG. 5A, the ROM 14 contains a control program area RO1 for storing various kinds of control programs, a character generation area RO2 for storing dot patterns representing characters corresponding to character codes input from the host computer 17 through the interface 18, and a speed pattern area RO3 for storing a speed pattern which is used to control, in the multi-pitch feed mode, the operation speed of the stepping motor 19 or the feed speed of the sheet of printing paper. The speed pattern area RO3 stores predetermined time data TS so that, when the paper feed mode is set at the multi-pitch feed mode in which the stepping motor is continuously rotated over a plurality of step angles (pitches), the step pulse is first supplied to the stepping motor 19 such that the paper feed is executed at a constant speed. The speed pattern area RO3 also stores time data TN . . . TO of a gradually increasing nature so that, when the number of the remaining pitches (rotation step angles) reaches a value N, the stepping motor 19 is rotated at a gradually decreasing speed.

Therefore, if the number of the remaining pitches exceeds the predetermined value N (corresponding to a lapse time $TN_A$) in the speed pattern area RO3, the above-mentioned lapse time is set to a given value TS whose corresponding time is shorter than a reference lapse time data (TO). If, in contrast, the number i is smaller than the predetermined value N, the value of the lapse time data (Ti) corresponding to the number of the remaining pitches i becomes greater as the number of the remaining pitches i becomes smaller. The lapse time corresponding to the remaining pitch 1 is set to the reference lapse time data (TO) in the one-pitch feed mode, in which the stepping motor 19 is intermittently rotated at the rate of one step angle in response to the step pulse.

Figure 5B:
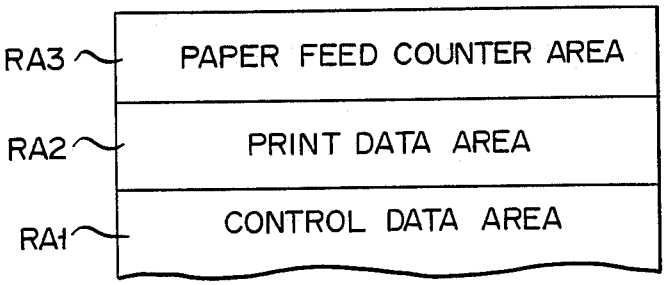

As shown in FIG. 5B, the RAM 15 contains a data area RA1 for temporarily storing various control data received through the interface 18, a print data area RA2 for temporarily storing a character code received through the interface 18, and a paper feed counter area for counting down the number of the remaining pitches each time the step pulse is supplied to the stepping motor 19.

Figure 6:
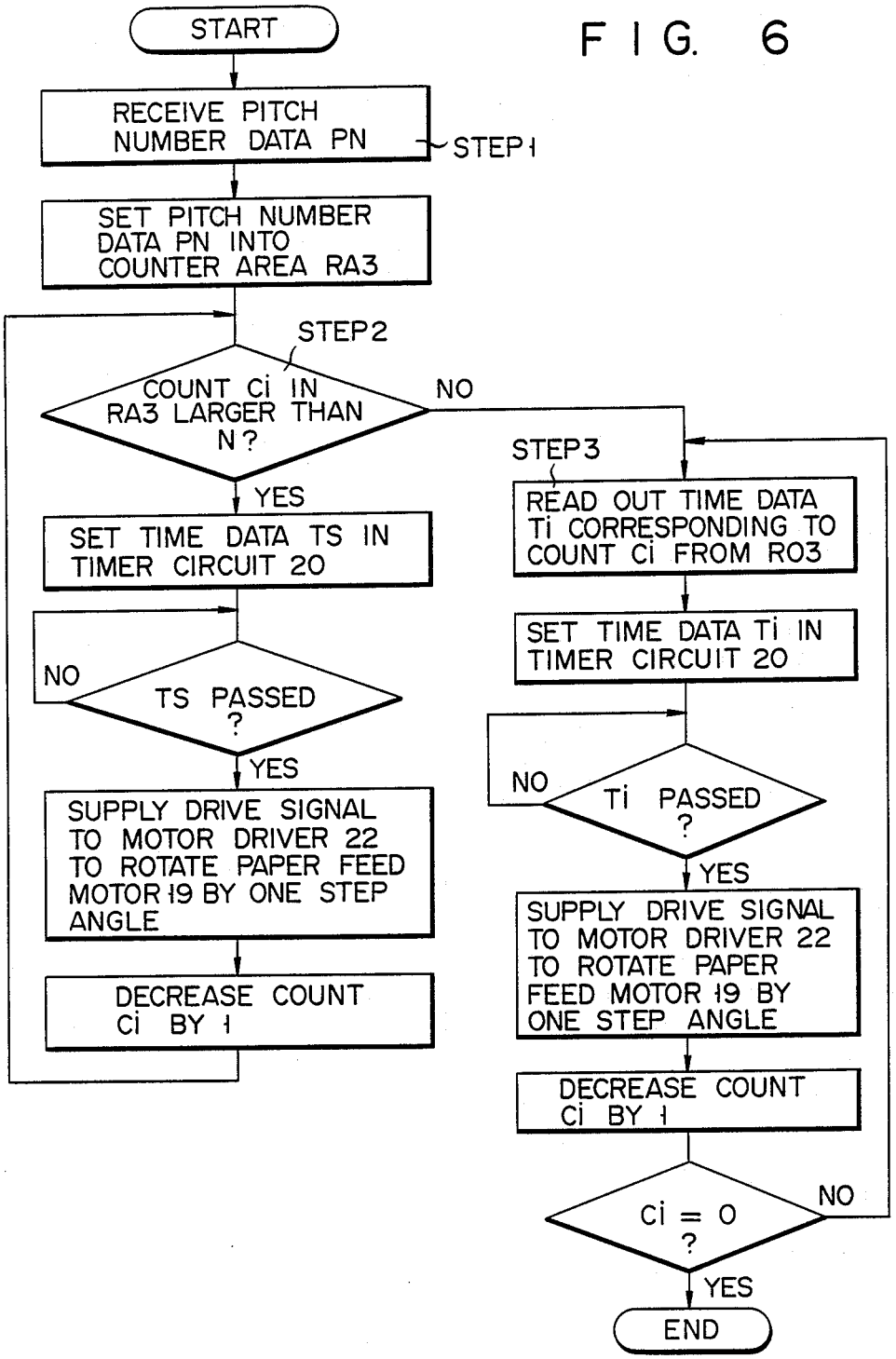
FIG. 6 shows a flow chart of the paper feed control apparatus as shown in FIG. 4.

The CPU 10 performs, upon receipt of a paper feed instruction from the host computer 17 through the interface 18, a paper feed processing with a sheet of printing paper set at the platen in accordance with the flow chart of FIG. 6. That is, in STEP 1 the CPU reads out, upon receipt of, for example, a paper feed instruction from the host computer 17, pitch number data representing the number of pitches (the number of the step angles) the motor is to be rotated at a time, and sets it in the RAM 15 at the paper feed counter area RA3, noting that the above-mentioned pitch number data, together with the paper feed instruction, is sent to the CPU 10. In consequence, the count value Ci, representing the number of the remaining pitches in the paper feed counter area RA3, becomes the value PN. In STEP 2, the CPU 10 checks whether or not the count value Ci of the paper feed counter area RA3 is larger than a predetermined value N stored in the ROM 14 at the speed pattern area RO3. If the count value Ci is confirmed as being larger than the predetermined value N, the lapse time data TS, corresponding to the respective pitch exceeding the number of the remaining pitches N+1, is set to the timer 20. As a result, the timer 20 is triggered, starting the count of the lapse time data TS. The CPU 10, upon receipt of an interrupt signal from the timer 20 at the completion of the counting of the lapse time data TS, delivers one step pulse to the stepping motor 19 through the paper feed motor driver 22. Then, the excitation current of the respective excitation phase is switched, causing the stepping motor 19 to be rotated through one step angle, i.e., by one pitch. As a result, the platen is rotated, feeding the sheet by one pitch. When the sheet is fed by the resultant one pitch, the count value Ci of the paper feed counter area RA3 of the RAM 15 is counted down by one, and then, the CPU 10 permits the process STEP 2 to be executed, checking whether or not the count value Ci, representing the number of the remaining pitches, reaches the predetermined value N. If the answer is "Yes", then the CPU 10 causes the stepping motor 19 to again be rotated by one step after the passage of the lapse time TS. If, conversely, the answer is "No", the CPU 10 executes the process of STEP 3, reads out the lapse time data Ti corresponding to the number of pitches representing the count value Ci from the speed pattern area RO3, and sets the lapse time data Ti to the timer 20. After the passage of the lapse time data Ti, the stepping motor 19 is rotated by one pitch, and then the count value Ci of the paper feed counter area RA3 is counted down by one. This operation is repeated until the count down value Ci becomes 0. Consequently, the lapse time data which is set to the timer 20 when the count value Ci is set at 1 becomes the reference lapse time (TO). The CPU 10 permits the stepping motor 19 to be rotated by one step after the passage of the reference lapse time TO, completing the paper feed process. In the final portion of the multi-pitch feed mode, the rotation speed of the stepping motor 19 is substantially the same as the reference speed VO attained in the one-pitch feed mode.

If, in STEP 1, the read-out pitch number data represents one pitch, it is only necessary to feed the sheet by one pitch. Therefore, the CPU 10 performs the process of STEP 3, reads out the reference lapse time data (TO) and sets it to the timer. After the passage of the reference lapse time TO, the stepping motor 19 is rotated by one pitch, completing the paper feed process. In such a one-pitch feed mode the stepping motor 19 is driven at the reference speed TO, completing the paper feed process.

Figures 7A, 7B:
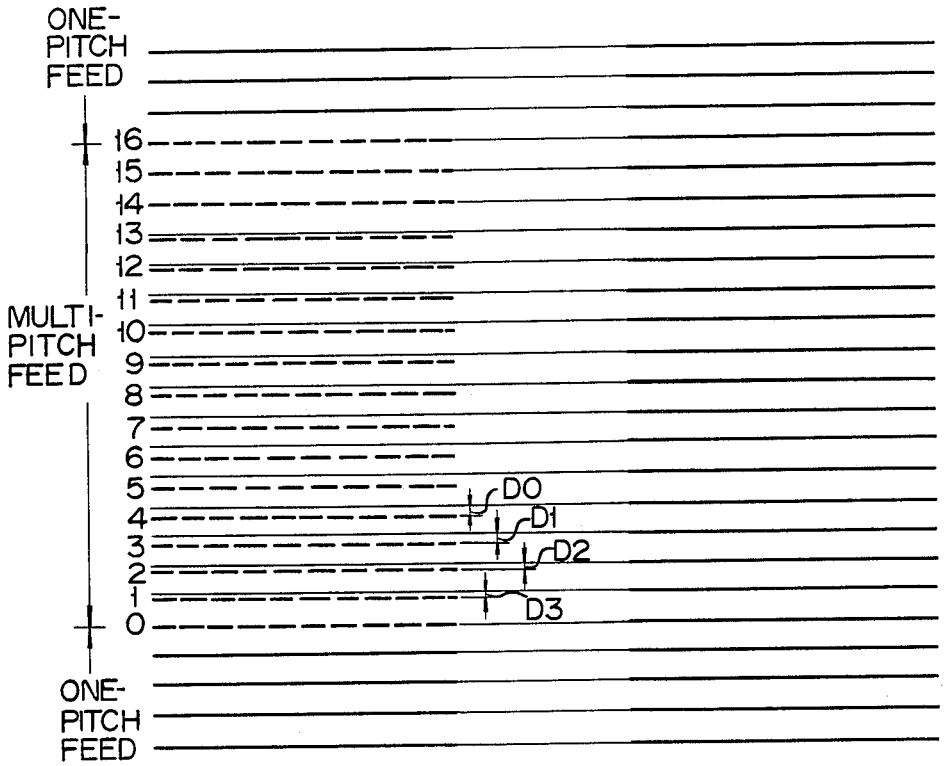
FIGS. 7A and 7B each show the amount of movement undergone by a sheet of printing paper sent from the paper feed control apparatus every time a step pulse is supplied to it in the multi-pitch feed mode and one-pitch feed mode of the paper feed apparatus.

An explanation will now be made of the cases where, in the paper feed control apparatus, a sheet of printing paper is fed, in a multi-pitch feed mode, fed sequentially up to 16 pitches, as in the case of FIGS. 7A and 7B. In FIG. 7A, the predetermined value N is set to 4.

Figure 3:
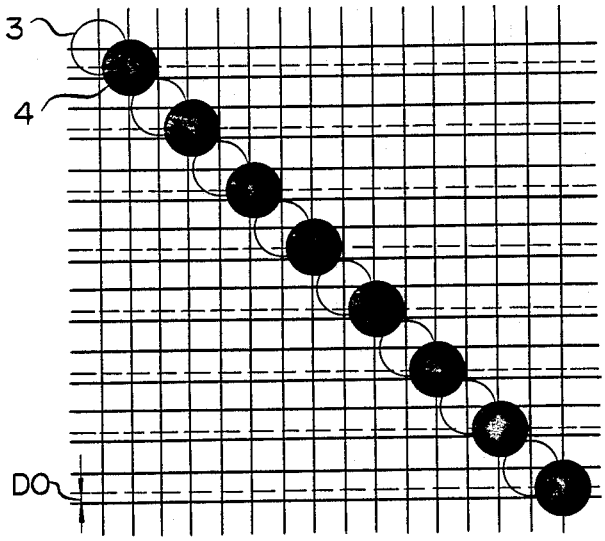
FIG. 3 (PRIOR ART)
FIG. 3 shows a diagonal line printed by a two-pass printing method on a printer having a conventional paper feed control apparatus.
Figure 2A:
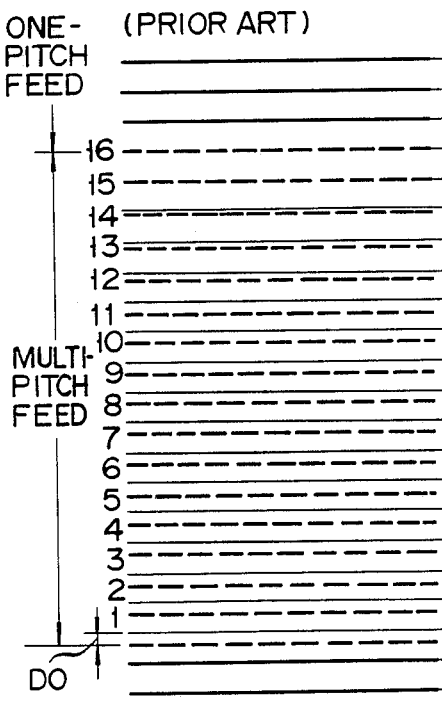
FIG. 2A (PRIOR ART)
FIGS. 2A and 2B each show the amount of paper fed to a stepping motor by a conventional paper feed control apparatus in a multi-pitch feed mode and a one-pitch feed mode each time a stepping pulse is supplied to the stepping motor.
Figure 2B:
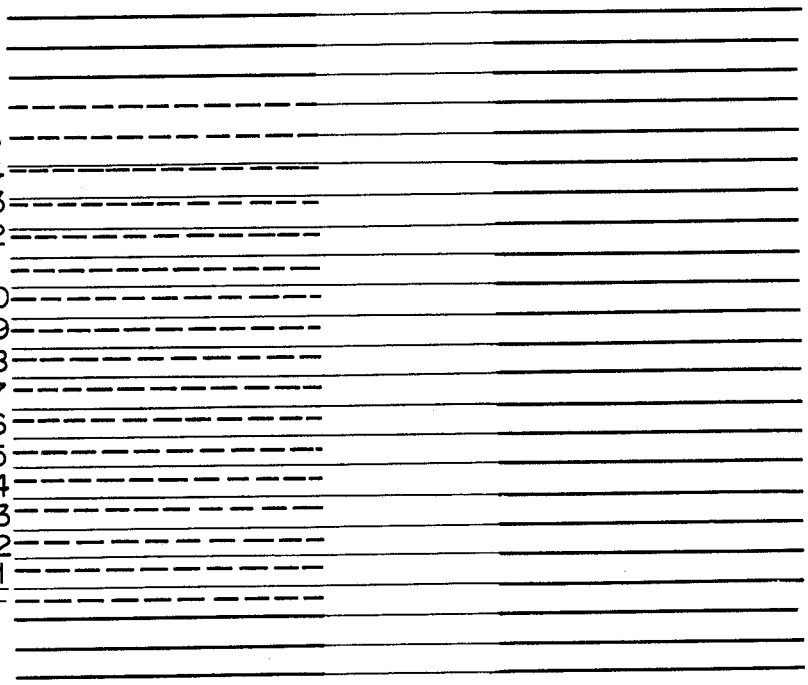
FIG. 2B (PRIOR ART)
Figure 8:
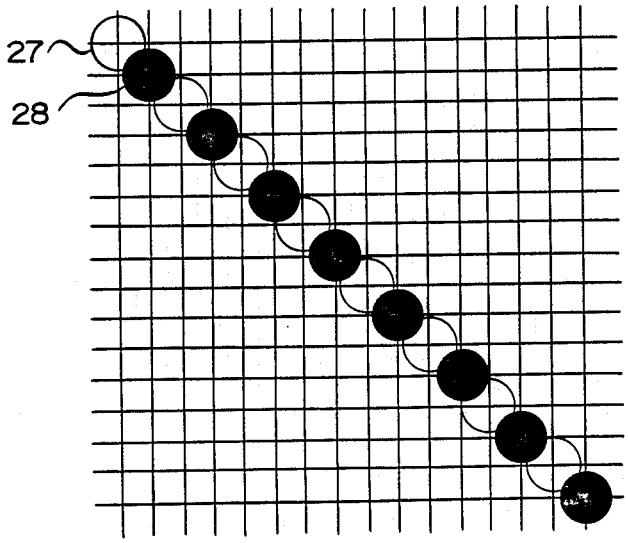
FIG. 8 shows a diagonal line printed by a two-pass printing method on the printer of FIG. 4.

Since the lapse time TS is shorter than the reference lapse time TO before the number of the remaining pitches Ci reaches the predetermined value N in the multi-pitch feed mode, the rotation speed of the stepping motor 19 is increased over that in the one-pitch feed mode, as shown in FIG. 7B, causing a discrepancy DO to occur between the one-pitch feed mode and the multi-pitch feed mode, as explained in connection with FIGS. 2A and 2B. When, however, the number of the remaining pitches Ci is decreased below the predetermined value N, the lapse time Ti gradually becomes longer, and thus the rotation speed of the stepping motor 19 is gradually reduced so that the discrepancy between the one-pitch feed mode and the multi-pitch feed mode is gradually decreased in the order of DO, D1, D2 . . . . When the number of the remaining pitches becomes 1, the rotation speed of the stepping motor 19 equals the rotation speed VO which is attained in the one-pitch feed mode. As a result, the displacement of the printing position, as occurs between the multi-pitch feed mode and the one-pitch feed mode, becomes zero, permitting substantially the same starting position to be obtained constantly, even after either the multi-pitch feed mode or the one-pitch feed mode is sequentially performed up to the 16 pitches.

Where the multi-pitch feed mode (as in the case of the character printing) for line feed and one-pitch feed mode for high-density character printing are carried out alternately, an alignment can be obtained between a diagonal array of dots, as indicated by open circles in FIG. 8, printed after the sheet has been fed in the multi-pitch feed mode, and a diagonal array of dots, as indicated by solid circles in FIG. 8, printed after the sheet has been fed in the one-pitch feed mode, thus producing no discrepancy DO as in FIG. 3. In consequence, it is possible to obtain a beautifully-detained, defined, clear dot pattern character of high quality.

Although this invention has been explained in connection with one embodiment, it is not restricted to this embodiment alone.

In the speed pattern table RO3 in the ROM 14, as shown in FIG. 5A, for example, those memory areas associated with the counts (N+1) to M may be omitted. As shown in FIG. 5A, if time data associated with the count (N+1) to M are stored in the medium speed pattern table RO3, the process of STEP 3 may be immediately executed in place of the process of STEP 2, after pitch number data PN, which was read out, has been stored in the counter area RA3.

What is claimed is:

1. A paper feed control apparatus for a dot printer of the type which prints characters by forming dots onto a paper with each two adjacent dots thereof being spaced from each other in a paper feed direction by a preselected distance, or pitch, said dot printer having a stepping motor for advancing paper in the paper feed direction, said stepping motor being rotatable in step increments with each being equal to said pitch, said stepping motor being selectively driveable in a one-pitch feed mode for advancing the paper for a distance equal to said pitch to an imprinting position and in a multi-pitch feed mode for advancing the paper in increments of said pitch over a plurality of pitches to an imprinting position, said control apparatus comprising:

motor driving means coupled to the stepping motor for generating driving signals to provide a one-pitch rotation of said motor;

timing means coupled to said motor driving means for actuating said driving signals and to control the time interval between said driving signals for thereby establishing the rotational speed of said motor, said time interval of the timing means being selectively settable;

memory means coupled to said timing means for storing a first time interval for said one-pitch feed mode and at least a second time interval for said multi-pitch feed mode, wherein said second time interval is shorter than said first time interval to produce a greater motor rotational speed during at least a portion of said multi-pitch feed mode; and means for determining the number of pitches to be rotated, for transferring one of the first and second time intervals corresponding to such number from the memory means to the timing means to thereby set said time interval of the timing means, and for transferring said first time interval from said memory means to said timing means when only one pitch remains to be rotated in said multi-pitch feed mode.

2. A paper feed control apparatus according to claim 1, wherein said at least a second time interval comprises a plurality of time intervals, one of said plurality of time intervals corresponding to motor pitches in a multi-pitch feed mode greater than N pitches and at least another of said plurality of time intervals corresponding to a number of pitches between one and N, said one time interval being shorter than said another time interval to thereby produce higher rotational motor speed for rotations greater than N.

3. A paper feed control apparatus according to claim 2, wherein said at least another of said plurality of time intervals comprises multiple time intervals of increasing duration in correspondence to a decrease in the number of remaining one-pitch rotations to produce lower rotational motor speed as the position for imprinting is approached.

4. A paper feed control apparatus according to claim 3, wherein said determining means comprises a counter into which an initial count is input corresponding to the total number of pitches to be rotated, and means for reducing the count in said counter by one for each one-pitch motor rotation.

5. A paper feed method for a dot printer of the type which prints characters by forming dots onto a paper with each two adjacent dots thereof being spaced from each other in a paper feed direction by a preselected distance, or pitch, said dot printer having a stepping motor for advancing paper in the paper feed direction, said stepping motor being rotatable in step increments with each being equal to said pitch, said stepping motor being selectively driveable in a one-pitch feed mode for advancing the paper for a distance equal to said pitch to an imprinting positon and in a multi-pitch feed mode for advancing the paper in increments of said pitch over a plurality of pitches to an imprinting position, said method comprising the steps of:

generating driving signals and controlling the time interval between said driving signals with a timing means for thereby establishing the rotational speed of said motor, said time interval being selectively settable;

storing a first time interval for said one-pitch feed mode and at least a second time interval for said multi-pitch feed mode in a memory, wherein said second time interval is shorter than said first time interval to produce a greater motor rotational speed during at least a portion of said multi-pitch feed mode; and determining the number of pitches to be rotated, and transferring one of the first and second time intervals corresponding to such number from the memory to the timing means to thereby set said time interval of the timing means;

said transferring step including transferring said first time interval from said memory to said timing means when only one pitch remains to be rotated in said multi-pitch feed mode.

6. A method according to claim 5, wherein said at least a second time interval comprises a plurality of time intervals, one of said plurality of time intervals corresponding to motor pitches in a multi-pitch feed mode greater than N pitches and at least another of said plurality of time intervals corresponding to a number of pitches between one and N, said one time interval being shorter than said another time interval to thereby produce higher rotational motor speed for rotations greater than N.

7. A method according to claim 6, wherein said at least another of said plurality of time intervals comprises multiple time intervals of increasing duration in correspondence to a decrease in the number of remaining one-pitch rotations to produce lower rotational motor speed as the position for imprinting is approached.

8. A method according to claim 7, wherein said determining step comprises inputting to a counter an initial count corresponding to the total number of pitches to be rotated, and reducing the count in said counter by one for each one-pitch motor rotation.

* * * * *